US007735584B2

(12) United States Patent
Purcell

(10) Patent No.: US 7,735,584 B2
(45) Date of Patent: Jun. 15, 2010

(54) PERCUSSION HAMMER FOR ENLARGING DRILLED HOLES

(75) Inventor: Joseph Purcell, Ennis (IE)

(73) Assignee: Minroc Technical Promotions Limited (IE)

( * ) Notice: Subject to any disclaimer, the term of this patent is extended or adjusted under 35 U.S.C. 154(b) by 70 days.

(21) Appl. No.: 11/991,899

(22) PCT Filed: Sep. 7, 2006

(86) PCT No.: PCT/IE2006/000095

§ 371 (c)(1),
(2), (4) Date: Mar. 12, 2008

(87) PCT Pub. No.: WO2007/034462

PCT Pub. Date: Mar. 29, 2007

(65) Prior Publication Data

US 2009/0071725 A1 Mar. 19, 2009

(30) Foreign Application Priority Data

Sep. 20, 2005 (IE) ..... S2005/0621

(51) Int. Cl.
*E21B 10/26* (2006.01)

(52) U.S. Cl. ..... 175/407; 175/389; 175/415

(58) Field of Classification Search ..... 175/407, 175/389, 415; 405/184, 184.1, 184.3
See application file for complete search history.

(56) References Cited

U.S. PATENT DOCUMENTS 4,117,895 A * 10/1978 Ward et al. ..... 175/53
4,836,306 A * 6/1989 Barrows ..... 175/321
4,862,976 A * 9/1989 Meek ..... 175/296
5,096,000 A * 3/1992 Hesse ..... 175/22
5,238,073 A * 8/1993 Rear ..... 175/53
5,494,116 A * 2/1996 Wentworth ..... 173/17
5,782,311 A * 7/1998 Wentworth ..... 175/53
5,791,419 A 8/1998 Välisalo ..... 175/53
5,803,187 A * 9/1998 Javins ..... 175/57
6,386,299 B1 5/2002 Kato ..... 175/62
6,394,197 B1 * 5/2002 Holte ..... 175/273
6,637,520 B1 * 10/2003 Purcell ..... 173/91
6,808,030 B2 * 10/2004 Klemm ..... 175/53
2003/0044238 A1 * 3/2003 Wentworth et al. ..... 405/184.3
2004/0089473 A1 * 5/2004 Kayes ..... 175/19
2006/0000646 A1 * 1/2006 Purcell ..... 175/296

FOREIGN PATENT DOCUMENTS

EP 0507610 10/1992
WO WO 00/55469 9/2000
WO WO 2004031530 A1 * 4/2004

* cited by examiner

*Primary Examiner*—William P Neuder
*Assistant Examiner*—Blake Michener
(74) *Attorney, Agent, or Firm*—Kusner & Jaffe

(57) ABSTRACT

The present invention relates to a percussion hammer for enlarging drilled holes. The hammer comprises an external outer wear sleeve (5), an inner cylinder (7) mounted co-axially within the outer wear sleeve (5), a tubular torque shaft (3) disposed axially and centrally of the hammer assembly, and extending longitudinally through the assembly. The hammer further comprises a sliding piston (6) mounted for reciprocating movement within the inner cylinder (7) and outer wear sleeve (10) and about the tubular torque shaft (3) to strike a hammer bit (1) for reciprocal movement in a chuck (4) adjacent a forward end of the hammer assembly. The hammer bit (1) has a central bore (46) through which the torque shaft (3) extends, such that the torque shaft (3) protrudes forwardly of the hammer.

9 Claims, 2 Drawing Sheets

PERCUSSION HAMMER FOR ENLARGING DRILLED HOLES

FIELD OF THE INVENTION

The invention relates to a fluid-operated percussion hammer for enlarging drilled holes. The invention is particularly concerned with a hammer for reaming pilot holes formed by directional drilling apparatus, or raise boring apparatus.

BACKGROUND TO THE INVENTION

It is known to use directional drilling apparatus to form substantially horizontal drill holes in the ground for installing electrical or telephone cables, gas or water pipes, or the like. The directional drilling equipment usually comprises a percussion drill bit operable through a drill string and includes a steering device so that the drill bit can be steered in a desired substantially horizontal direction below and along the route of roads and streets, and under river beds, roads and the like. Such directional drilling apparatus is well known and is disclosed, for example, in WO 97/49889, U.S. Pat. No. 6,705,415, and US 2004/0188142A.

In a typical directional drilling system, a drill string incorporating a percussion hammer, to apply axial impact forces to the drill bit, is utilised to drill an initial pilot hole of a small diameter (for example 133 mm) than the diameter of the ultimate passage desired. The ultimate drill passage may have a diameter of anything from 200 mm to 760 mm depending upon the size of the cables, pipes or conduits to be inserted in the drilled passageway.

With the known horizontal drilling method, when the percussion drill bit and hammer breaks through the surface after having drilled the pilot hole, the percussion hammer system is removed and a reamer bit is fixed to the protruding drill rod. Using the drill string, the reamer bit is then pulled back against the face of the drilled pilot hole. By means of a rotary force only (i.e. without percussion) the hole is then reamed by the reamer bit to the required larger diameter. Because there are no percussion forces involved the penetration rate of the reamer is very slow, particularly in hard rock formations. Back-Reaming tools are disclosed, for example, in US 2002/0108785A, Another known method of enlarging the pilot hole is to remove the drill string including the percussion drill hammer from the pilot hole and then using another hammer system with a larger bit to ream the hole to size. For example, U.S. Pat. No. 4,249,620 discloses a method of boring holes which includes forming an open-ended pilot bore by means of a first self-propelled displacement hammer of smaller diameter. Next a cable is introduced through the pilot bore and then the diameter of the pilot bore is increased to form the hole by means of a second displacement hammer of greater diameter. The second displacement hammer is guided through the pilot bore by pulling it with the cable, which for this purpose is attached to the leading end of the second hammer. The disadvantage of this system is that because the initial drill string has been removed there is a danger that the larger hammer system will deviate from the course of the pilot hole. For example, it may drift to one or other side of the axis of the pilot hole. Also there can be a risk of the pilot hole collapsing in broken conditions.

It is known to use similar methods to enlarge pilot holes drilled by raise boring apparatus in the drilling of vertical elevator shafts and the like. The pilot hole is drilled vertically downwards, and then using the pilot hole as a guide, a drill head is pulled upwardly to enlarge the hole. An example of such a drill head is disclosed in US 2004/0188142A. This drill head utilises at least two, and preferably three impact hammers.

EP 0 507 610 A (Rear) discloses an uphole hammer comprising a substantially tubular housing which is closed at one end and supports a substantially centrally located fluid supply tube at said one end. The fluid supply tube extends axially through the housing and is connected at its other end to drill a string, and receives fluid being directed to the hammer by the drill string. The housing supports a drill bit at its other end, which is slidably received about the fluid supply tube. A piston also is slidably supported about the fluid supply tube in the housing for reciprocation between the drill bit and the end of the housing. Fluid porting means is provided to alternately admit fluid to the spaces defined between each end of the piston and the respective ends of the housing to effect reciprocation of the piston between a first position at which it impacts on the drill bit and a second position at which it lies in the vicinity of the end of the housing.

The uphole hammer disclosed in EP 0 507 610 A suffers from a number of disadvantages. It discloses a centrally located fluid supply tube (13) which extends axially through the hammer housing (11). The tube serves to transmit torque and to regulate the piston cycle. Because of the complicated machined shapes of the tube and the provision of ports 30*a* and 30*b* cut through the wall of the tube, the structure of the tube is significantly weakened for the purpose of torque transmission. The clearance between the piston and the tubes must be sufficiently small to provide the sealing necessary to operate the piston cycle. The small clearance in conjunction with the torque transmission, and weakening of the wall structure, places excessive stress and bending on the tube. For example because of the presence of ports 30*a* and 30*b*, and the requirement for a tight running clearance with the piston, it is likely that the tube will distort under torque. Avoiding the clearance problem may necessitate that the clearance between the piston and the tube be increased, thus reducing efficiency.

Also, in EP 0 507 610 A, the drill bit (18) is retained in the drivel-sub bit support (17) by a bit retaining ring (19), which results in a relatively weak bit design. Furthermore, in EP 0 507 610 A, the back end of the hammer comprises an end plate (12) fixed to the tubular housing (11) by studs (15) and to one end of the fluid supply tube (13) by a second set of studs (16). There is a high risk that in operation the variation of the system would cause studs to loosen which would result in very serious damage to the hammer.

OBJECT OF THE INVENTION

It is an object of the invention to provide an improved method and apparatus for reaming drilled pilot holes utilising horizontal directional drilling or raise boring. It is a particular object of the invention to provide a system and apparatus in which a fluid operated hammer drill capable of combined percussion and rotary drilling is guided through the pilot hole by means of the original drill string to increase the diameter of the hole.

SUMMARY OF THE INVENTION

In one aspect the invention provides a percussion hammer for enlarging drilled holes comprising an external outer wear sleeve, an inner cylinder mounted co-axially within the outer wear sleeve, a tubular torque shaft disposed axially and centrally of the hammer assembly, and extending longitudinally through the assembly, a sliding piston mounted for reciprocating movement within the inner cylinder and outer wear sleeve and about the tubular torque shaft to strike a hammer bit for reciprocal movement in a chuck adjacent a forward end of the hammer assembly, the hammer bit having a central bore through which the torque shaft extends, such that the torque shaft protrudes forwardly of the hammer, characterised in that a) an adaptor, for connection to a drill string, is screw-threadably connected to the forward end of the torque shaft; b) the rearward end of the torque shaft is screw-threadably connected to the back-head locking member; c) the rear end of the wear sleeve is screw-threadably connected to the back-head locking member; and d) the forward end of the wear sleeve is screw-threadably connected to the chuck.

Preferably, the screw-thread connections a) and b) are made in the same direction as the direction of rotation of the drill string and connections c) and d) are made in the opposite direction to that of the drill string. Suitably, the screw-thread connection for a) and b) is by means of a right-hand thread and that of c) and d) is by means of a left-hand thread.

In a third aspect, the invention provides a percussion hammer for enlarging drilled holes comprising an external outer wear sleeve, an inner cylinder mounted co-axially within the outer wear sleeve, a tubular torque shaft disposed axially and centrally of the hammer assembly, and extending longitudinally through the assembly, a sliding piston mounted for reciprocating movement within the inner cylinder and outer wear sleeve and about the tubular torque shaft to strike a hammer bit for reciprocal movement in a chuck adjacent a forward end of the hammer assembly, the hammer bit having a central bore through which the torque shaft extends, such that the torque shaft protrudes forwardly of the hammer, characterised in that an adaptor, for connection to a drill string, is screw-threadably connected to the forward end of the torque shaft and acts as a forward stop for forward movement of the bit and to retain the bit in the chuck.

In a further aspect, the invention provides a percussion hammer for enlarging drilled holes comprising an external outer wear sleeve, an inner cylinder mounted co-axially within the outer wear sleeve, a tubular torque shaft disposed axially and centrally of the hammer assembly, and extending longitudinally through the assembly, a sliding piston mounted for reciprocating movement within the inner cylinder and outer wear sleeve and about the tubular torque shaft to strike a hammer bit for reciprocal movement in a chuck adjacent a forward end of the hammer assembly, the hammer bit having a central bore through which the torque shaft extends, such that the torque shaft protrudes forwardly of the hammer, characterised in that a) an adaptor, for connection to a drill string, is screw-threadably connected to the forward end of the torque shaft;

b) the rearward end of the torque shaft is screw-threadably connected to a back-head locking member; and c) the rear end of the wear sleeve is screw-threadably connected to the back-head locking member.

In a further aspect the invention provides percussion hammer for enlarging drilled holes comprising an external outer wear sleeve, an inner cylinder mounted co-axially within the outer wear sleeve, a tubular torque shaft disposed axially and centrally of the hammer assembly, and extending longitudinally through the assembly, a sliding piston mounted for reciprocating movement within the inner cylinder and outer wear sleeve and about the tubular torque shaft to strike a hammer bit for reciprocal movement in a chuck adjacent a forward end of the hammer assembly, the hammer bit having a central bore through which the torque shaft extends, such that the torque shaft protrudes forwardly of the hammer, characterised in that the rear end of the torque shaft is connected to a back-head locking member, and the rearward end of the back-head locking member has connection means whereby the hammer may tow cables, pipes or the like through the enlarged hole.

Preferably, the back-head locking member is provided with means, suitably a screw-thread attachment means, whereby a second drill string may be towed behind the hammer during enlargement of the drilled hole. This has the advantage that, if after the pilot hole has been enlarged, it is found necessary to carry out additional reaming of the drilled hole, the rear trailing drill string can be disconnected from the back-head locking member, the hammer turned around, and connected, to the forward end of the torque shaft. The hammer can be guided by the trailed drill string back through the reamed hole to remove any obstructions.

In yet a further aspect the invention provides a percussion hammer for enlarging drilled holes comprising an external outer wear sleeve, an inner cylinder mounted co-axially within the outer wear sleeve, a tubular torque shaft disposed axially and centrally of the hammer assembly, and extending longitudinally through the assembly, a sliding piston mounted for reciprocating movement within the inner cylinder and outer wear sleeve and about the tubular torque shaft to strike a hammer bit for reciprocal movement in a chuck adjacent a forward end of the hammer assembly, the hammer bit having a central bore through which the torque shaft extends, such that the torque shaft protrudes forwardly of the hammer, characterised in that a rear end of the torque shaft is connected to a back-head locking member and a fluid channel in the torque shaft is in fluid connection with a fluid distribution chamber contained within the back-head locking member. Preferably, the fluid distribution chamber is fitted with a check valve to control distribution of fluid from the chamber to the piston.

DETAILED DESCRIPTION OF THE DRAWINGS

Figures 1, 2, 3:
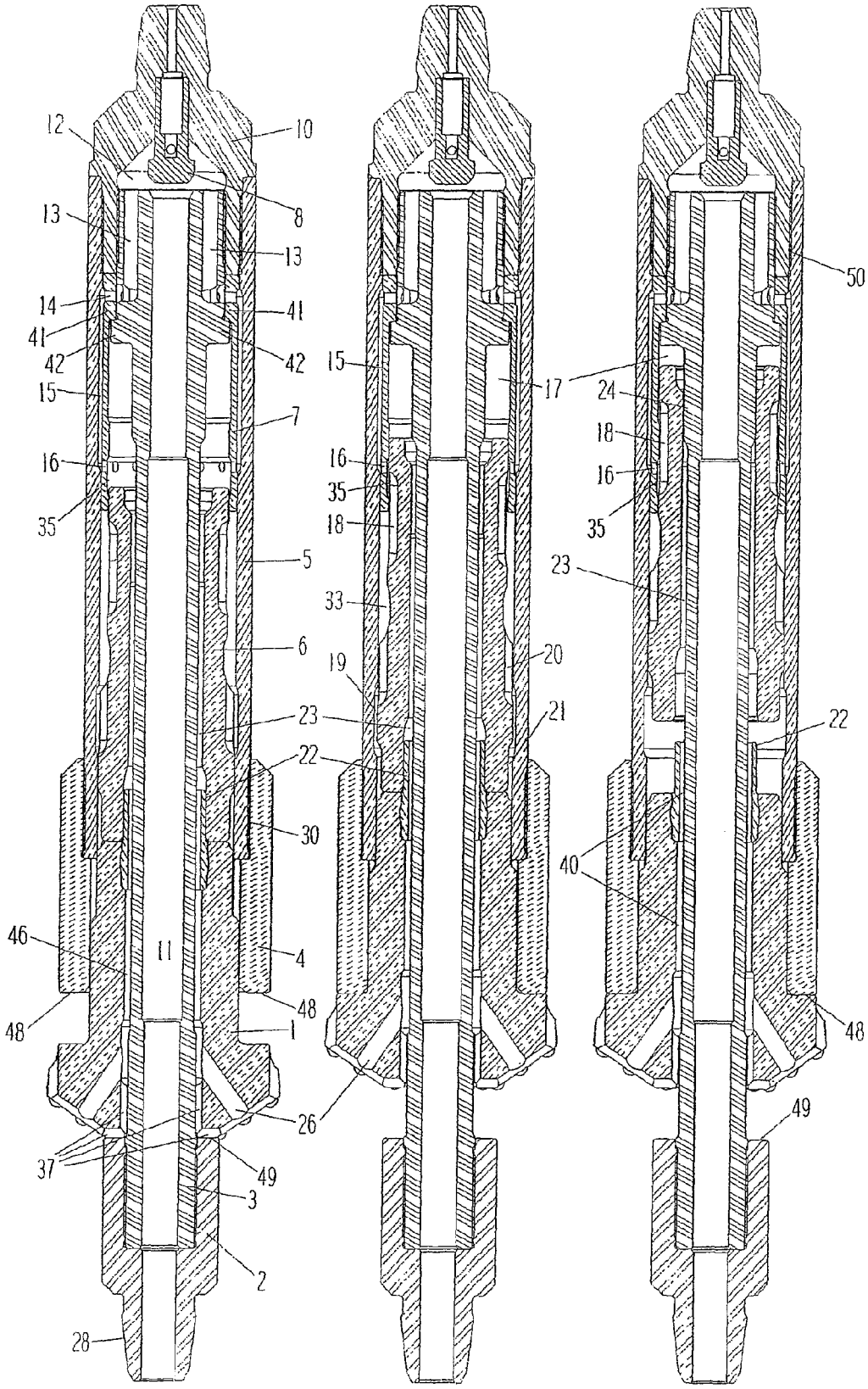
FIG. 1 is a side elevation of one embodiment of a combined percussion and rotary drilling hammer for use in the method and apparatus of the invention, showing the bit extended from the hammer in blow mode (i.e. at the start of drilling)
FIG. 2 shows the system in strike position.
FIG. 3 shows the system in which the piston of the hammer is at the top of its stroke.

Referring to FIGS. 1 to 4 of the accompanying drawings, these show one embodiment of a combined percussion and rotary drilling hammer of the invention. The construction and operation of the apparatus of the invention is as follows:

The hammer comprises an external outer wear sleeve 5, which is threadably connected at its rear end to a backhead locking member 10. Preferably, the locking member 10 has an externally screw-threaded cylindrical portion 50 which engages with an internally screw-threaded end of the wear sleeve 5. A check valve 8 is mounted within and centrally of the locking member 10. The check valve 8 is in fluid communication with an air distribution chamber 12 within the locking member 10. The check valve 8 is spring-mounted, in well-known manner, by means of a compression spring 9 (see FIG. 4).

An inner cylinder 7 is mounted co-axially within the outer wear sleeve 5. A tubular torque shaft 3 is disposed axially and centrally of the hammer assembly. The torque shaft 3, is threadably connected at its rear end (top end as shown in the drawings) to the locking member 10. An externally screw-threaded end portion 47 of the shaft 3, which is of enlarged diameter, engages with the inner wall of the cylindrical portion 50 of the locking member 10, which is internally screw-threaded. The opposite, front end, of the torque shaft 3 is externally screw-threaded to engage with an internally screw-threaded cylindrical part of an adaptor 2. The adaptor 2 is mounted on the front end (lower end as shown in the drawings) and will be described more fully below.

The torque shaft 3 defines an internal longitudinal passageway 11, which extends axially for the length of the torque shaft 3, and which is in fluid communication with the air distribution chamber 12. The tubular torque shaft is connected via adaptor 2, in use of the system, to the drill string of the drilling rig and compressed air is supplied from the drill string through the central passageway 11 of the torque shaft 3 to supply compressed air to the assembly to operate a piston 6, as will be described more fully below. The torque shaft 3 also serves the dual role of transmitting rotary forces from the drill string to cause the hammer to rotate to effect a rotary drilling, in well-known manner.

The combined percussion and rotary drilling hammer described in this embodiment is a pneumatically operated hammer utilising compressed air. It will be appreciated that the hammer may also be hydraulically operated, in which case a hydraulic fluid is used instead of compressed air.

Figure 4:
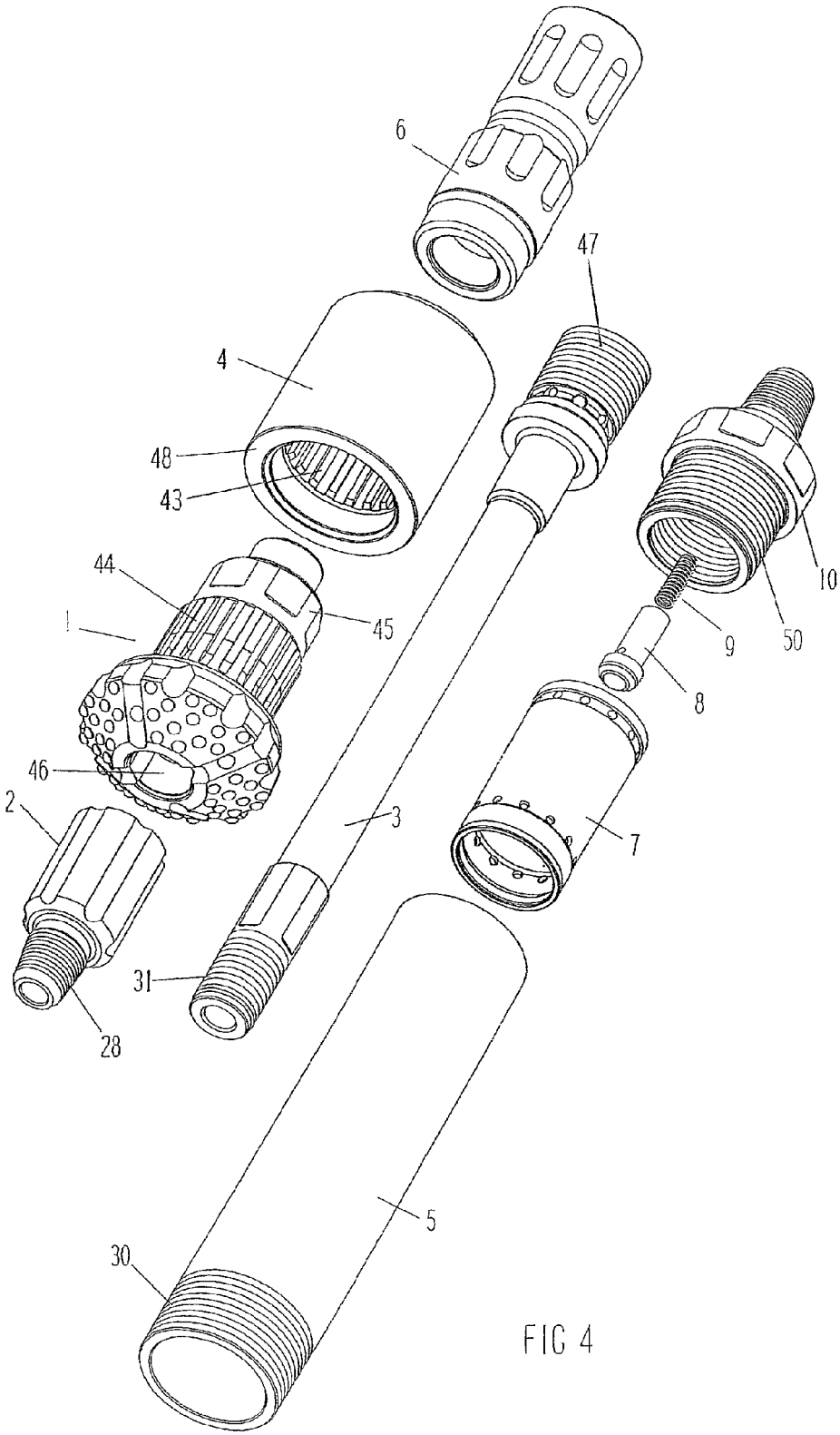
FIG. 4 is an exploded view of the hammer of the invention.

The rear end of the inner cylinder 7 has an inwardly directed flange 41, which is clamped between an annular shoulder 42 on the torque shaft, by means of the backhead locking member 10, which when screwed down locks the inner cylinder 7 in position relative to the outer wear sleeve 5, for example in the matter described in our WO 2004/039530. As shown in FIGS. 1 and 4, the forward end of the wear sleeve 5 has an externally screw-threaded portion 30 to which is threadably attached a cylindrical chuck 4. The rear end of the chuck 4 is threaded to engage with the threaded portion 30 of the wear sleeve 5. The forward end of the chuck 4 is formed internally with axial splines 43 which are adapted to engage with complementary external splines 44 formed on a shank 45 of a hammer bit 1 (see FIG. 4). The co-operating splines 42, 43 allow the bit 1 to move in a reciprocating axial movement relative to the chuck 4 and also transmit torque from the chuck 4 to the bit 1. The forward end of the chuck 4 has an annular end face 48, which acts as an abutment for the bit 1

The drill bit 1 has an internal axial bore 46 through which the tubular torque shaft 3 extends such that the bit 1 is able to move in a reciprocating movement over the torque shaft 3.

A sliding piston 6 is mounted for reciprocating movement within the inner cylinder 7, and the outer wear sleeve 5, to strike the hammer bit 1 which slides axially within the chuck 4.

When the parts are assembled the forward threaded end portion 31 of the torque shaft 3 protrudes forwardly of the hammer bit to threadably engage with the adaptor 2.

The adaptor 2 acts as a bit retaining means for locking the bit 1 in position during operation of the hammer. It provides a much stronger and effective bit retaining system than that disclosed in the prior art. The adaptor 2 has a rearwardly-facing annular end face 49 (see FIG. 2), which acts as a stop to forward movement of the bit 1.

A forward end of the adaptor 2 has a connection portion 28, which suitably is externally screw-threaded for connection to a drill rod of the drill string.

Preferably, the rearward end of the back-head locking member 10 has connection means, e.g. a screw-thread connection by means of which a variety of systems may be towed behind the hammer when in use. For example, it is possible to attach a hook or eye to the member 10, should it be desired to tow pipes or cables through the hole, as it is drilled by the hammer, for installation purposes.

An important and innovative feature of the invention is the method by which various parts of the hammer are assembled together.

As indicated above the parts are connected as follows:

a) the adaptor 2 is screw-threadably engaged with the forward end of the torque shaft 3;

b) the rearward end of the torque shaft 3 is screw-threadably engaged with the back-head locking member 10;

c) the wear sleeve 5 is screw-threadably engaged with the back-head locking member 10;

d) the wear sleeve 5 is screw-threadably engaged with the chuck; and

It is important that the direction of rotation in tightening the screw-thread connection for connections a) and b) is in the same direction as the direction of rotation of the drill string. The drill string thread direction is also in the same direction as the direction of rotation. The drill string usually rotates clock-wise and so there should be a clock-wise tightening of the screw thread connection; that is the screw should have a right-hand thread; whereas on the contrary the screw thread connection for connections c) and d) above should be in the opposite direction; i.e. if the drill-string rotates clock-wise, these connections should be tightened anti-clockwise, using a left-hand thread. Obviously, if the drill string rotates anti-clockwise, the opposite will be the case, and a) and b) will then utilise the left-hand thread, and c) and d) a right-hand thread.

This arrangement ensures that the connections between the parts referred to are maintained tightly connected despite vibrations of the hammer during use of the system.

In operation of the invention, when a pilot hole is drilled, and the original percussion drilling system is removed from the drill rods at the breakthrough point of the pilot hole, one is left with a drill string protruding out of the end of the pilot drill hole. The percussion drilling hammer of the invention is attached to the protruding drill rod by connection means. The connection means preferably comprise the adaptor 2 which, as described above has an externally screw-threaded connection portion 28, which connects with the foremost drill rod. The largest diameter of the adaptor 2 is nominally smaller than the pilot hole. For example, its largest diameter may be 127 mm where the pilot hole has a diameter of 133 mm. The drilling hammer is then operated and is guided along the pilot hole by pulling back on the drilling string. This ensures that the hammer does not deviate from the track of the pilot hole as it enlarges the pilot hole.

Referring to FIGS. 1, 2, 3 the operation of the hammer is as follows. FIG. 1 shows the hammer in blow mode i.e. no hammering is taking place. Compressed air is supplied from the drill string down the air passage 11 in the torque shaft 3 to push open the check valve 8 and to permit the compressed air to enter the air-distribution chamber 12. From here the air flushes through an annular chamber 13, ports 14 to chamber 15, holes 16, annular chamber 23 between the piston 6 and the torque shaft 3. The flow of air continues down to exit through the holes 26 and grooves 37 in the bit to the cutting face of the bit.

FIG. 2 shows the hammer in the strike position. The bit 1 has been pushed back into assembly (by sliding rearwardly along the splines 43 and over the torque shaft 3), as the system is pulled back, by the drill string onto face of hole being reamed. This inward travel of the bit 1 is limited by the end face 48 of the chuck 4. Compressed air is supplied from chamber 15 through holes 16 to an undercut 35 in the inner cylinder 7. From here the air passes along ports 18 in piston 6 to the annular chamber 33, undercut 19, ports 20 to a lift chamber 21, which is sealed in the piston bore by a foot valve 22.

Simultaneously a top drive chamber 17 is open to exhaust through chamber holes 23, 26, and grooves 37.

FIG. 3 shows the piston 6 at top of stroke. The lift chamber 21 is open to exhaust through passages 40, holes 26, and grooves 37. The top drive chamber 17 is supplied with compressed air through holes 16, undercut 35, and ports 18, and forces the piston 6 back down to strike the bit 1 as the chamber 17 is sealed in the piston bore by means of the raised diameter portion 24 on the torque shaft 3.

To stop the hammer operation, the system is pushed off the face of reamed hole and the bit 1 is pushed out of the assembly until it sits on the annular face 49 of the adaptor 2.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A percussion hammer for enlarging drilled holes comprising an external outer wear sleeve (5), an inner cylinder (7) mounted co-axially within the outer wear sleeve (5), a tubular torque shaft (3) disposed axially and centrally of the hammer assembly, and extending longitudinally through the assembly, a sliding piston (6) mounted for reciprocating movement within the inner cylinder (7) and outer wear sleeve (5) and about the tubular torque shaft (3) to strike a hammer bit (1) for reciprocal movement in a chuck (4) adjacent a forward end of the hammer assembly, the hammer bit (1) having a central bore (46) through which the torque shaft (3) extends, such that the torque shaft (3) protrudes forwardly of the hammer bit (1), characterised in that a) an adaptor (2), for connection to a drill string, is screw-threadably connected to the forward end of the torque shaft (3);

b) the rearward end of the torque shaft (3) is screw-threadably connected to a back-head locking member (10);

c) the rear end of the wear sleeve (5) is screw-threadably connected to the back-head locking member (10); and d) the forward end of the wear sleeve (5) is screw-threadably connected to the chuck (4); and wherein for connections a) and b) above the screw-thread connection is in one direction and for connections c) and d) the screw-thread connection is in the opposite direction or rotation.

2. A percussion hammer as claimed in claim 1 characterised in that screw-thread connections a) and b) are made in the same direction as the direction of rotation of the drill string and connections c) and d) are made in the opposite direction to that of the drill string.

3. A percussion hammer as claimed in claim 2 wherein the screw-thread connection for a) and b) is by means of a right-hand thread and that of c) and d) is by means of a left-hand thread.

4. A percussion hammer as defined in claim 1, wherein said adapter (2) acts as a forward stop for forward movement of the bit (1) and to retain the bit (1) in the chuck (4).

5. A percussion hammer as defined in claim 1, wherein the back-head locking member has connection means whereby the hammer may tow cables, pipes or the like through the enlarged hole.

6. A percussion hammer as claimed in claim 5, wherein the back-head locking member is provided with means whereby a second drill string may be towed behind the hammer during enlargement of the drilled hole.

7. A percussion hammer as claimed in claim 6, wherein the means is a screw-thread attachment means.

8. A percussion hammer as defined in claim 1, wherein a fluid channel in the torque shaft is in fluid connection with a fluid distribution chamber contained within the back-head locking member.

9. A percussion hammer as claimed in claim 8, wherein the fluid distribution chamber is fitted with a check valve to control distribution of fluid from the chamber to the piston.

* * * * *